US005924574A

United States Patent [19]

Ku

[11] Patent Number: 5,924,574

[45] Date of Patent: Jul. 20, 1999

[54] ARTICLE CONTAINER CAPABLE OF ABSORBING SHOCK

[76] Inventor: Tun-Jen Ku, 16, Kuo Chung 2nd Rd., Da-Li City Taichung, Taiwan

[21] Appl. No.: 09/044,968

[22] Filed: Mar. 19, 1998

[51] Int. Cl.[6] ..... B65D 69/00; B65D 71/00

[52] U.S. Cl. ..... 206/583; 206/320

[58] Field of Search ..... 206/320, 521, 206/522, 523, 583

[56] References Cited

U.S. PATENT DOCUMENTS

| | | | |
|---|---|---|---|
| 2,295,590 | 8/1942 | Manson et al. | 206/521 |
| 2,363,249 | 11/1944 | Hutchinson | 206/522 |
| 3,044,161 | 7/1962 | Morrison | 206/583 |
| 4,044,867 | 8/1977 | Fisher | 190/43 |
| 4,376,494 | 3/1983 | Bjurling | 220/444 |
| 4,566,588 | 1/1986 | Kataczynski | 206/597 |
| 4,573,202 | 2/1986 | Lee | 206/522 |
| 4,826,329 | 5/1989 | Bellini | 383/98 |
| 5,143,283 | 9/1992 | Lancaster | 229/199 |
| 5,217,131 | 6/1993 | Andrews | 206/522 |
| 5,655,662 | 8/1997 | Garcia | 206/583 |

*Primary Examiner*—Paul T. Sewell
*Assistant Examiner*—Nhan T. Lam
*Attorney, Agent, or Firm*—W. Wayne Liauh

[57] ABSTRACT

An article container is composed of a frame and a main body suspended in the frame. The frame is formed of a plurality of support rods coupled by the connectors. The support rods are provided with support straps for supporting and suspending the main body such that an interstice is formed between the frame and the main body. The main body is provided with a receiving space and a cushioned layer surrounding the receiving space which is intended to accommodate the article. The cushioned layer is formed of a plurality of foam bodies and air sacs. The foam bodies are capable of absorbing shock, whereas the inflated air sacs serve to locate the article in the receiving space. The article kept in the receiving space of the main body is thus well protected when the article container is impacted on by an external force.

4 Claims, 9 Drawing Sheets

ARTICLE CONTAINER CAPABLE OF ABSORBING SHOCK

FIELD OF THE INVENTION

The present invention relates generally to a container, and more particularly to a container for holding a precision article.

BACKGROUND OF THE INVENTION

As shown in FIG. 1, a prior art container similar in design to the briefcase is intended for use in carrying a precision device, such as a notebook computer. The container has a soft housing and a soft interior for protecting the precision device from wear resulting from friction. Such a prior art container as described above is incapable of protecting the precision device from impact. An improved version of the prior art container is shown in FIG. 2 and is composed of a rigid housing and a padded interior which is provided with a locating seat for securing the precision device. This improved container is in fact incapable of protecting the precision device from the shock when the container is impacted violently in view of the fact that the interior of the container is not provided with an effective shock-absorbing means, and that the padded interior of the container is very limited in its capability to mitigate the impact force imparted to the interior from the rigid housing.

SUMMARY OF THE INVENTION

The primary objective of the present invention is to provide an

The primary objective of the present invention is to provide an improved article container capable of absorbing shock effectively so as to protect an article held in the container.

In keeping with the principle of the present invention, the foregoing objective of the present invention is attained by an article container which is intended to hold a precision device such as a notebook computer. The article container consists of a frame and a main body. The frame is formed of a plurality of support rods, which are coupled by a plurality of connectors to from a framework in which the main body is located such that an interstice is formed between the frame and the main body, and that the main body is held and suspended by a plurality of support straps of the support rods. When the article container is impacted on by an external force, the interstice serves to prevent the main body form making contact with the frame so as to protect an article which is held in a receiving space of the main body. In addition, the main body is balanced and confined by the support straps which are made of a pliable material. The receiving space of the main body is protected by a cushioned layer formed of a plurality of foam bodies and air sacs which can be inflated via an air valve of the main body. The foam bodies and the air sacs of the cushioned layer are arranged in a chainlike manner that each air sac is located between two foam bodies. The inflated air sacs serve to locate the article in the receiving space of the main body, whereas the foam bodies serve to absorb the shock imparted from the frame. The article container is provided with a bag to facilitate the carrying of the article container.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
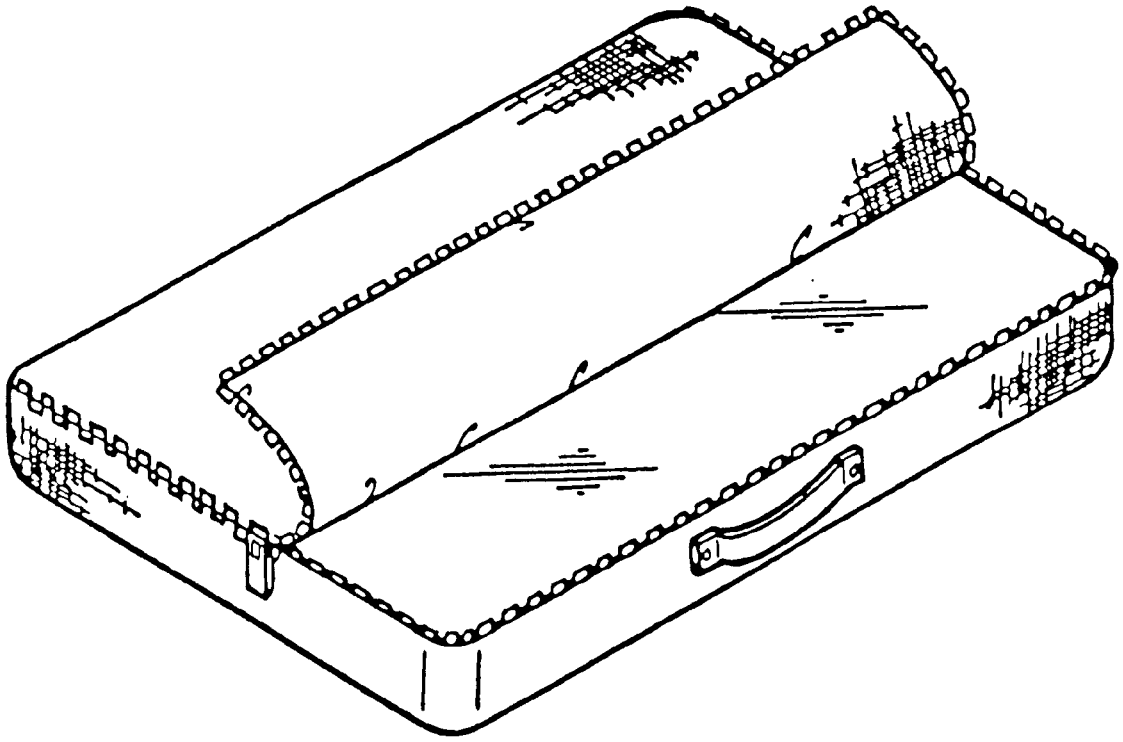
Fig. 1 PRIOR ART
FIG. 1 shows a perspective view of an article container of the prior art.
Figure 2:
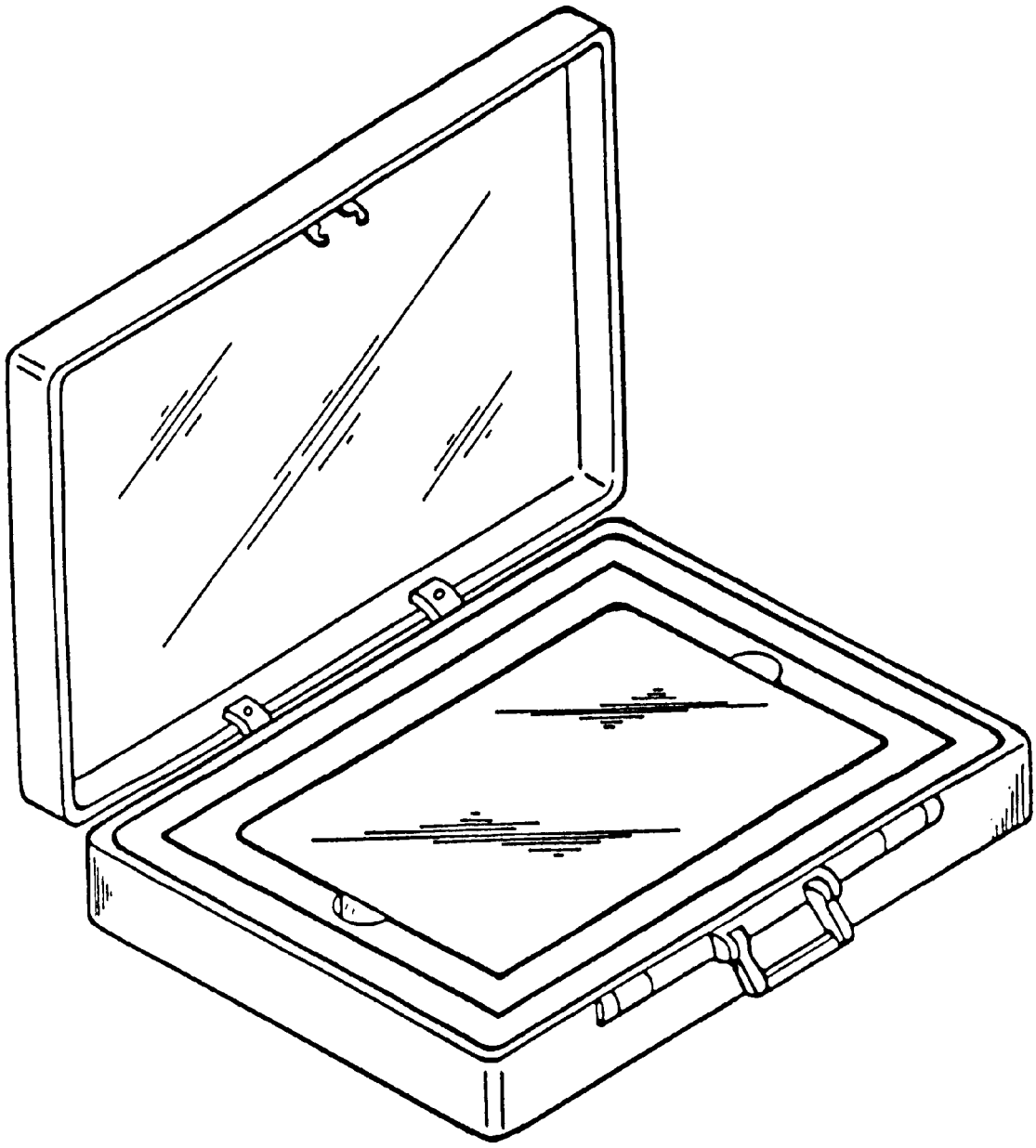
Fig. 2 PRIOR ART
FIG. 2 shows a schematic view of an article container of the prior art.
Figure 3:
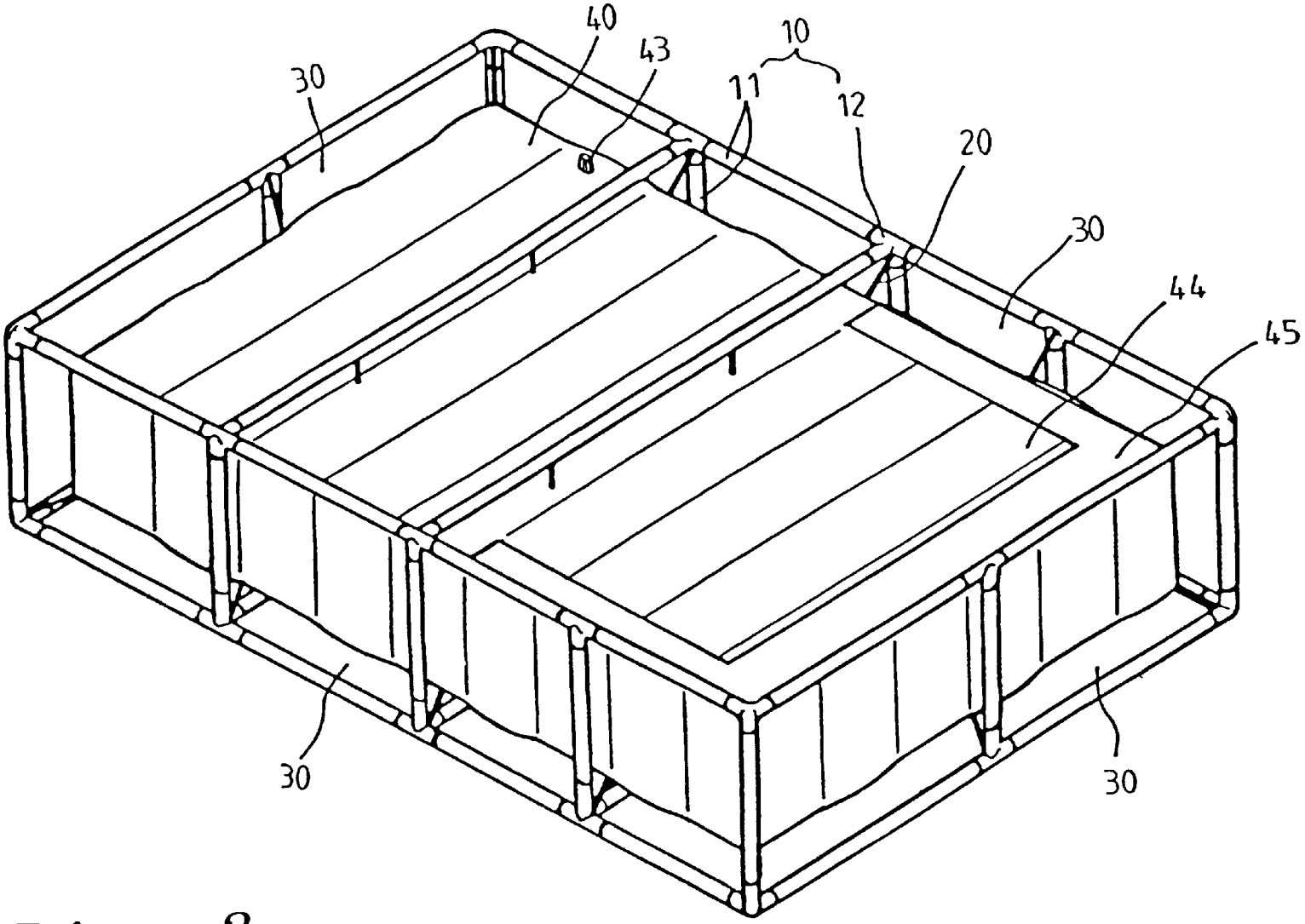
FIG. 3 shows a perspective view of an article container of the present invention.
Figure 4:
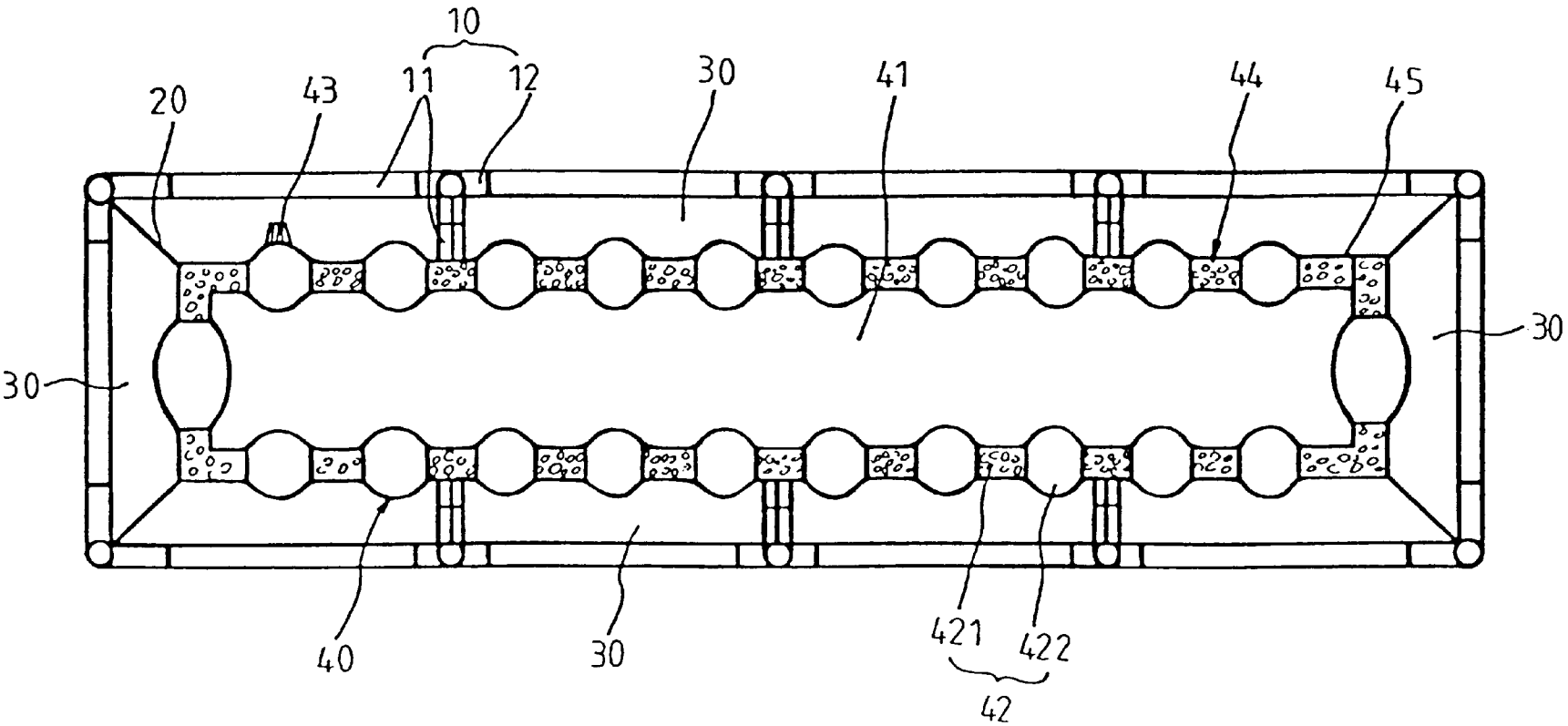
FIG. 4 shows a sectional schematic view of the article container of the present invention.
Figure 5:
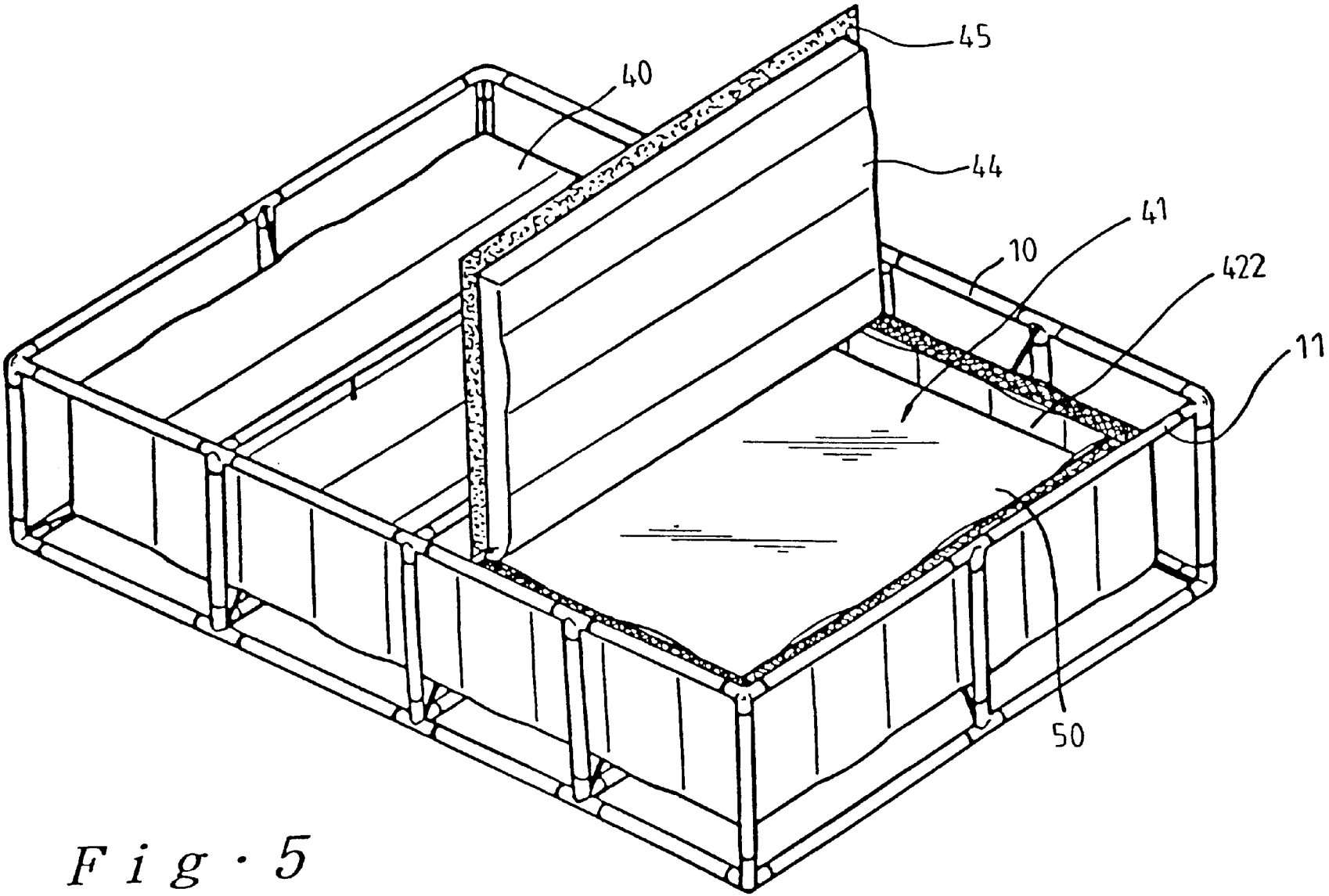
FIG. 5 shows a schematic view of the present invention.
Figure 6:
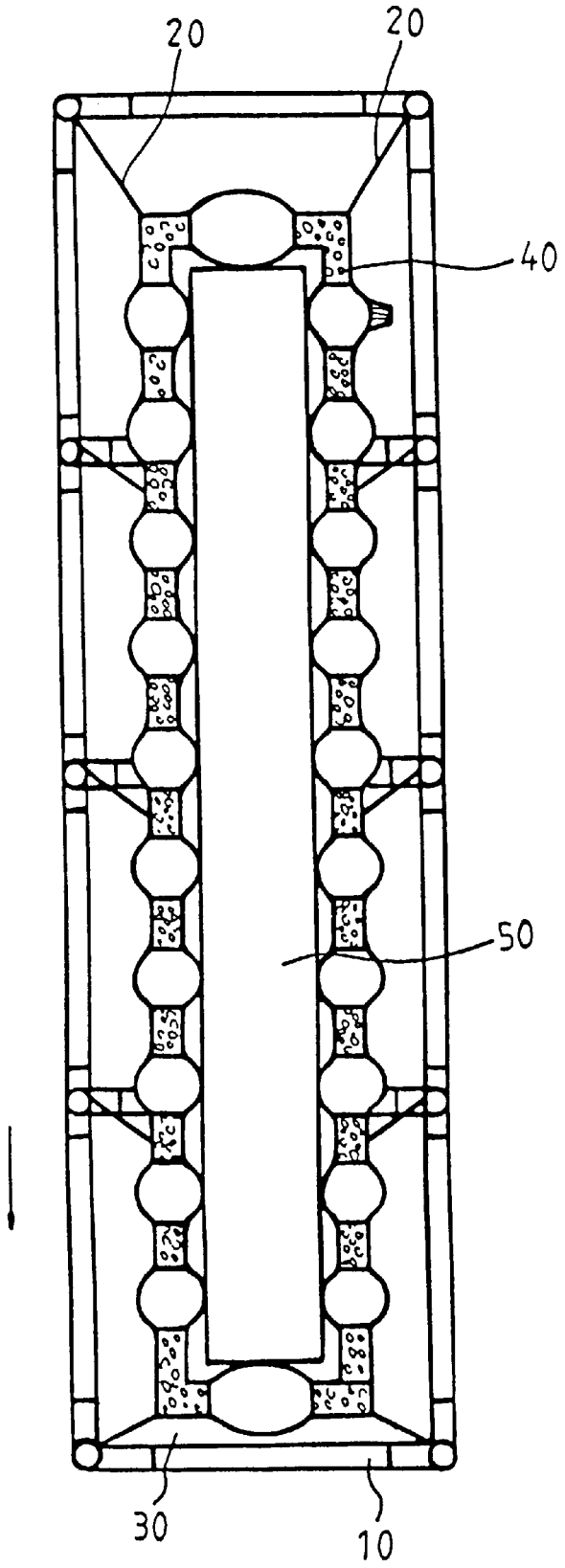
FIGS. 6–8 show sectional schematic views of the present invention at work.
Figure 7:
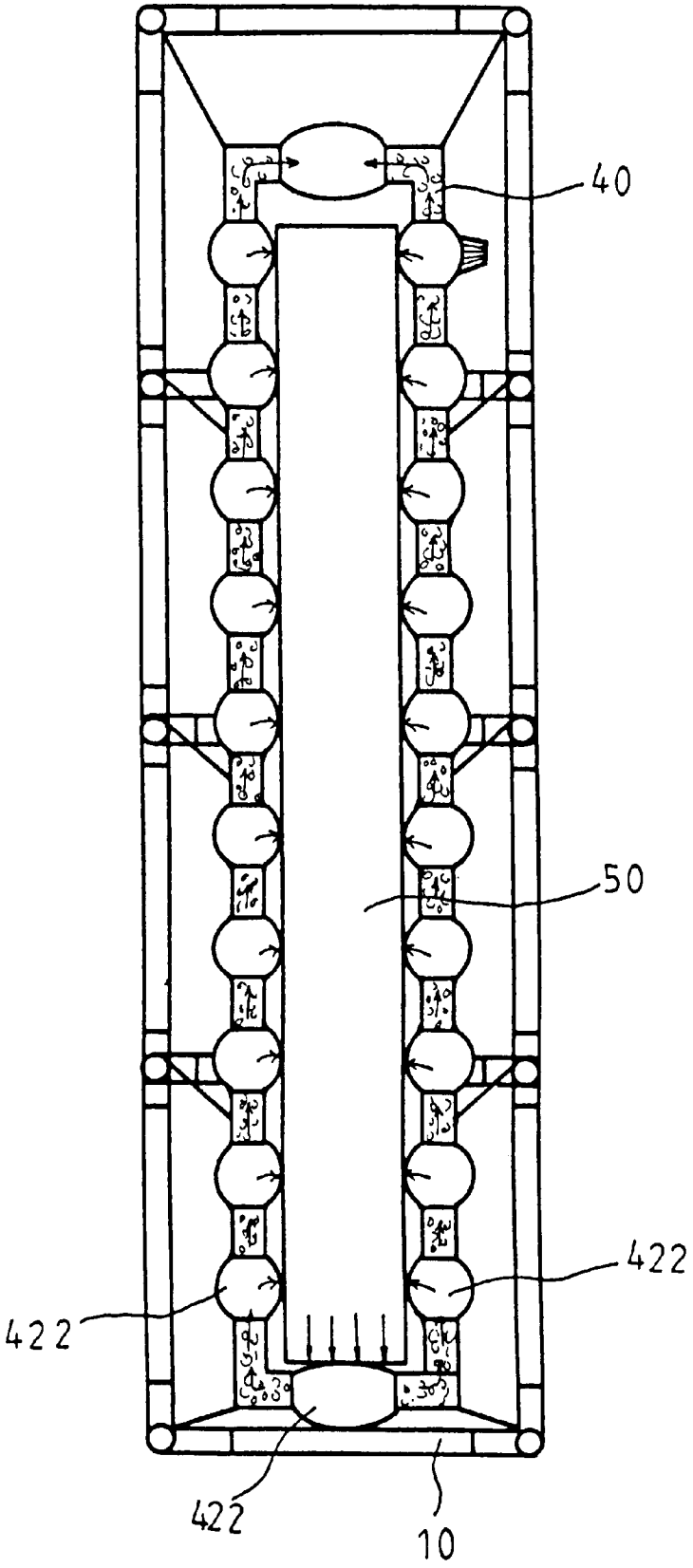
Figure 8:
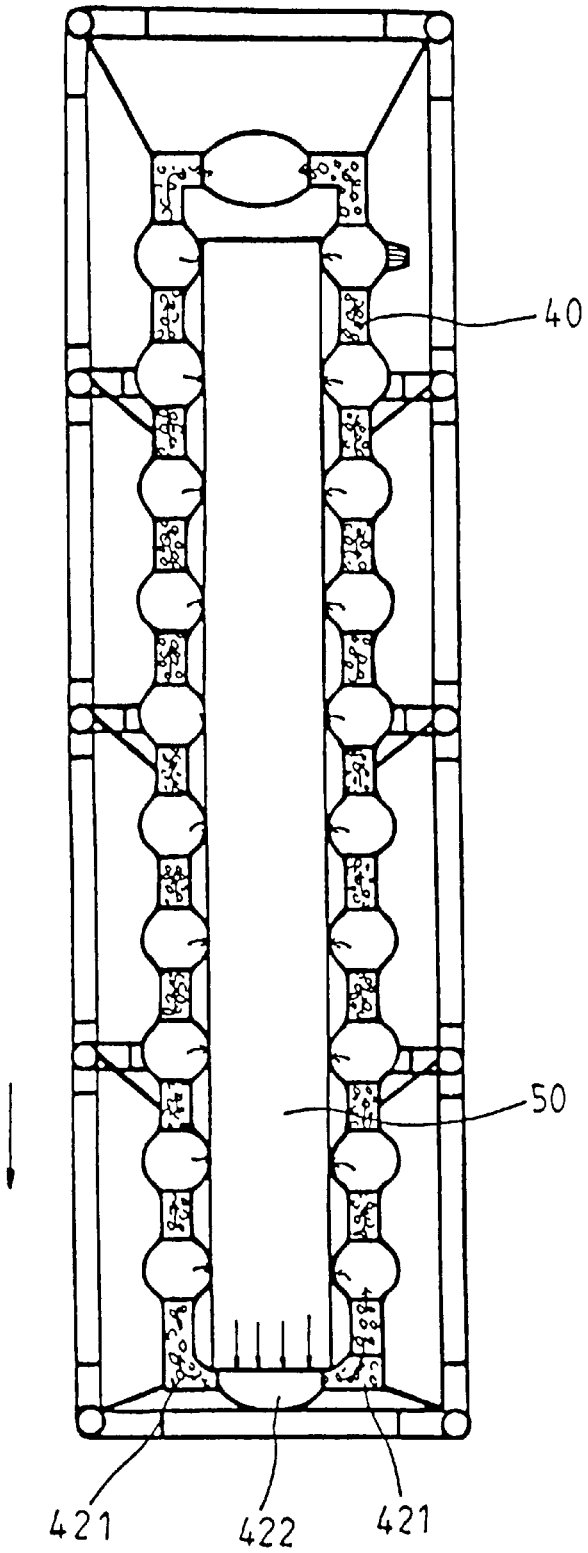

As shown in all drawings provided herewith, an article container embodied in the present invention is composed of a frame 10 and a main body 40.

The frame 10 is made up of a plurality of support rods 11 which are coupled by a plurality of connectors 12 to form a framework. The support rods 11 are provided respectively with a plurality of pliable support straps 20 for holding and suspending the main body 40 such that an interstice 30 is formed between the frame 10 and the main body 40. The main body 40 is provided therein with a receiving space 41 for accommodating an article 50 or precision device. The receiving space 41 of the main body 40 of the present invention is intended to accommodate a notebook computer. When the article container of the present invention is impacted on by an external force, the interstice 30 serves to prevent the main body 40 from making contact with the frame 10 so as to protect the article 50 which is held in the receiving space 41 of the main body 40. In addition, the main body 40 is balanced and confined by the support straps 20 such that the main body 40 is not affected by the impact force exerting on the frame 10. The main body 40 is further provided with a cushioned layer 42 for minimizing the effect of the impact force exerting on the frame 10. The cushioned layer 42 is composed of a plurality of foam bodies 421 and inflatable air sacs 422. The foam bodies 421 and the air sacs 422 are arranged in a chainlike manner that each air sac 422 is located between two foam bodies 421. The foam bodies 421 are capable of absorbing shock imparted from the frame 10. The air sacs 422 can be inflated via an air valve 43 of the main body 40. The inflated air sacs 422 are capable of locating securely the article 50 in the receiving space 41 of the main body 40 such that the protruded portions of the inflated air sacs 422 are in intimate contact with the article 50 kept in the receiving space 41.

The main body 40 is provided with an opening through which the article 50 is put into the receiving space 41 or taken out of the receiving space 41. The opening is provided with a flap 44 fastened thereto for shielding the article 50 contained in the receiving space 41. The flap 44 is provided with a retaining device 45 enabling the flap 44 to remain in the state of covering the opening of the main body.

Figure 9:
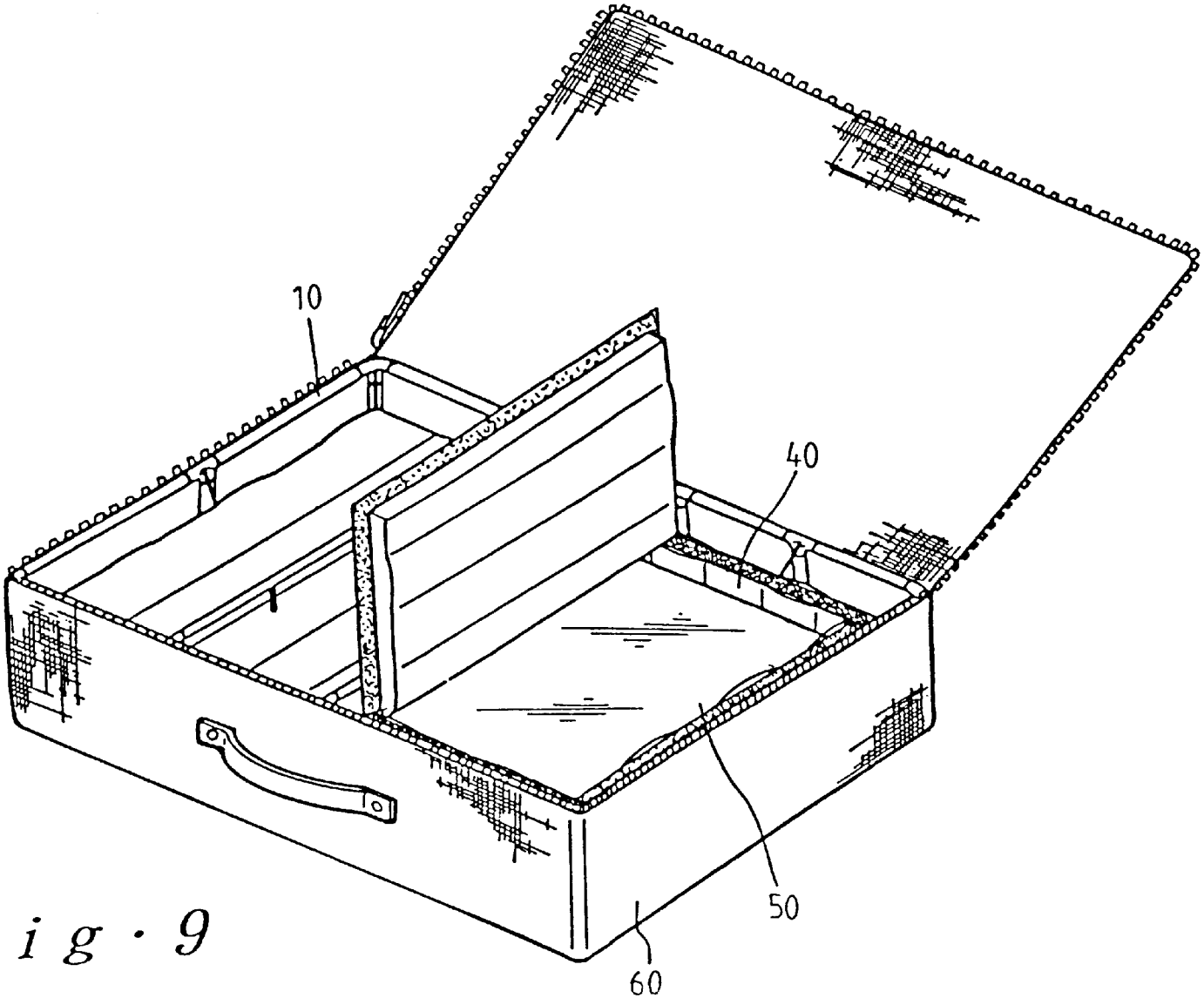
FIG. 9 shows a schematic view of the present invention in conjunction with a bag for carrying the present invention.

As shown in FIG. 9, the article container of the present invention is provided with a bag 60 to facilitate the carrying of the article container of the present invention. The bag 60 is a nonrigid container and is shaped like a suitcase.

To sum up, the article container of the present invention is capable of protecting the article from the impact force in light of the interstice 30 and the foam bodies 421 of the cushioned layer 42. In addition, the article 50 is held securely in the receiving space 41 of the main body 40, thanks to the inflated air sacs 422 which remain in intimate contact with the article 50.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A article container comprising:

a frame made up of a plurality of support rods, said support rods being provided respectively with at least one pliable support strap attached thereto; and a main body supported and suspended in said frame by said support straps of said support rods such that an interstice is formed between said frame and said main body, said main body being provided with a receiving space for accommodating an article, a cushioned layer surrounding said receiving space, and an opening for putting the article into said receiving space or taking the article out of said receiving space;

wherein said cushioned layer comprises a plurality of foam bodies and inflatable air sacs; and wherein said main body is provided with an air valve fastened thereto for inflating said air sacs of said cushioned layer;

further wherein said foam bodies and said air sacs are arranged in a chainlike manner that each of said air sacs is arranged between two of said foam bodies.

2. The article container as defined in claim 1, wherein said support rods of said frame are coupled by a plurality of connectors.

3. The article container as defined in claim 1, wherein said opening of said main body is provided with a flap fastened thereto.

4. The article container as defined in claim 1, is provided a bag to facilitate the carrying of the article container.

* * * * *